US005322490A

United States Patent [19]

Van Der Hoeven

[11] Patent Number: 5,322,490

[45] Date of Patent: Jun. 21, 1994

[54] STEPPING AND SLIDING EXERCISER

[76] Inventor: Martin A. Van Der Hoeven, 3330 Carlsbad Blvd., Carlsbad, Calif. 92008

[21] Appl. No.: 18,275

[22] Filed: Feb. 16, 1993

Related U.S. Application Data

[63] Continuation-in-part of Ser. No. 955,339, Oct. 1, 1992.

[51] Int. Cl.[5] ..... A63B 23/04; A63B 21/00

[52] U.S. Cl. ..... 482/51; 482/52; 482/908; 472/90

[58] Field of Search ..... 482/51, 52, 54, 908; 242/67.1 R, 67.4; 434/253; 472/90, 91

[56] References Cited

U.S. PATENT DOCUMENTS

| | | | |
|---|---|---|---|
| 2,715,788 | 8/1955 | Gutshall | 242/67.1 R |
| 4,940,226 | 7/1990 | Carra | 482/51 |
| 5,114,387 | 5/1992 | Keppler | 482/51 |
| 5,133,700 | 7/1992 | Braathen | 482/51 |
| 5,158,512 | 10/1992 | Irwin et al. | 482/52 |
| 5,162,028 | 10/1992 | Wilkinson | 482/52 |

OTHER PUBLICATIONS

The Stepshaper Instruction Booklet date Aug. 1991 from Weslo.

*Primary Examiner*—Richard J. Apley
*Assistant Examiner*—Jeanne M. Mollo
*Attorney, Agent, or Firm*—Henri J. A. Charmasson

[57] ABSTRACT

An aerobic exercise platform comprises a rigid base having a smooth and slick surface for practicing sliding exercises. Elastic or rigid holding elements are securable to a series of anchoring points located about the periphery of the base. An alternate embodiment of the invention combines a sliding exerciser with a stepping exercise stool. The stool is constituted by the two symmetrical halves of an enclosure housing a web wound around a drum. When the two halves of the enclosure are spread apart the web is deployed. The slick upper side of the web acts as a sliding surface.

17 Claims, 7 Drawing Sheets

STEPPING AND SLIDING EXERCISER

PRIOR APPLICATION

This is a continuation-in-part application of copending application Ser. No. 07/955,339 filed Oct. 1, 1992.

FIELD OF THE INVENTION

This invention relates to home exercising equipment, and more specifically to stepping exercise devices and to sliding exercise devices used in lieu of treadmills.

BACKGROUND OF THE INVENTION

The healthy popularity of aerobic and other forms of physical exercises has prompted the development of low-cost and practical devices to allow individuals to practice at home certain exercises that could formerly be practiced only with complex apparatuses found in health clubs, professionals' offices and physical therapy departments of hospitals. For instance, a sheet of plastic laid over a floor and a pair of sliding booties have been used to practice sliding exercises as a substitute for the walking exercises that can be done on treadmills.

Fitness enthusiasts do not usually limit their practice to one type of exercise, and thus are required to acquire several pieces of equipment. This multiplicity of exercising devices is not only costly, but also requires a great deal of practice and storage space.

There is a need for a more practical sliding/walking device which could more accurately simulate the function of a treadmill and other professional aerobic apparatuses.

SUMMARY OF THE INVENTION

The principal and secondary objects of this invention are to provide a practical and inexpensive means for practicing aerobic exercises which formerly could only be practiced over complex professional machines, and more particularly sliding exercisers which simulate walking such as can be practiced on a treadmill, as well as stepping exercises by combining several exercising apparatuses in a single compact device. These and other objects are achieved by a rigid, foldable and easily carried platform having a smooth or slick top surface and equipped with elastic or rigid pulling elements anchored about the periphery of the platform, and, in an alternate embodiment by a web having a similar smooth and slick surface and being deployed from a container doubling as a stepping exercise stool.

DESCRIPTION OF THE PREFERRED EMBODIMENT OF THE INVENTION

Figure 1:
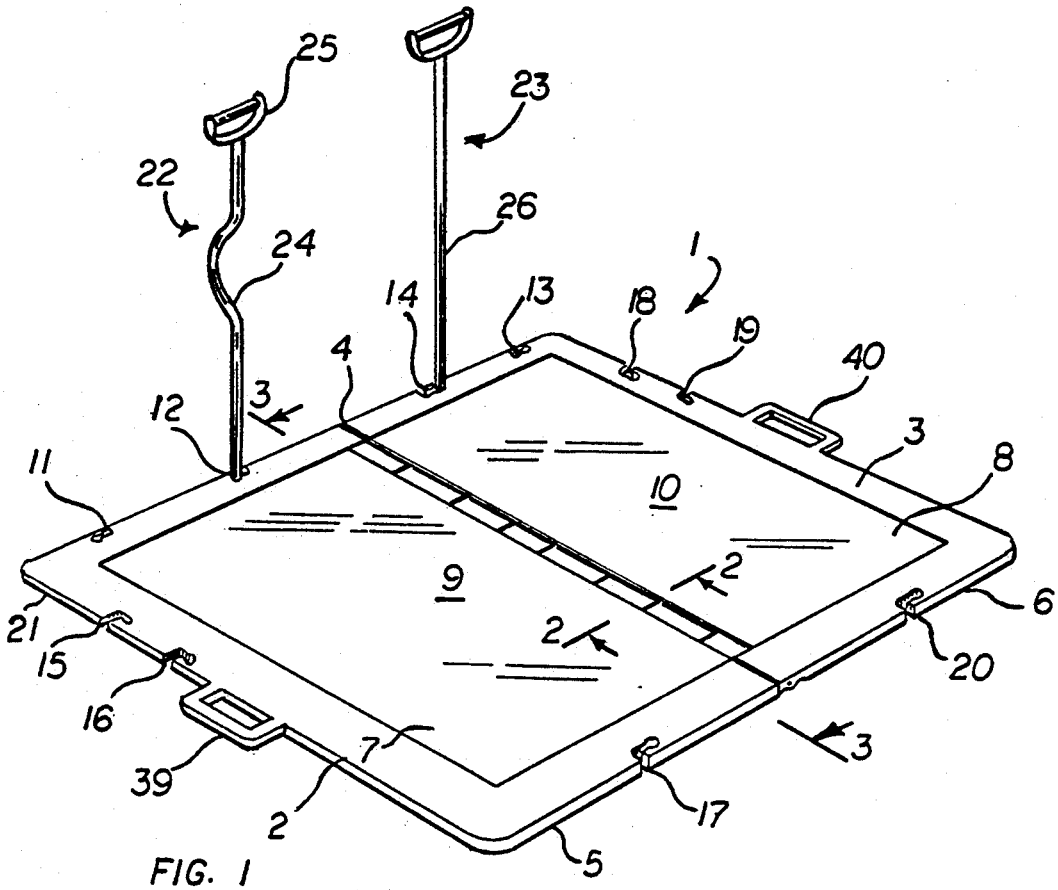
FIG. 1 is an isometric view of the sliding exercise platform.

Referring now to the drawing, there is shown in FIG. 1 the preferred embodiment of the sliding exercise platform which comprises two symmetrical planar members 2, 3 rotatively connected by a hinged section 4 along one of their respective edges. Each planar member comprises a rigid frame 5, 6 upon which is mounted a sheet 7, 8 of smooth and slick material such as polypropylene or Teflon R forming a very slippery surface 9, 10. A plurality of L-shaped notches 11–20 are cut into the periphery of the platform to provide anchoring points for pulling elements 22 or 23.

Pulling element 22 comprises a flexible, elastic cord 24, preferably a length of surgical tubing, having at a proximal end a handle 25 and at the opposite end a knot or ball shaped and dimensioned to be retained in one of the slots 11–20. In pulling element 23 which may be used in lieu of, or in addition to, pulling element 22, the flexible, elastic rope is replaced by a solid, rigid rod 26. A pair of either one of the two described pulling elements may be used to perform a variety of exercises on the platform as will be described later.

Figure 2:
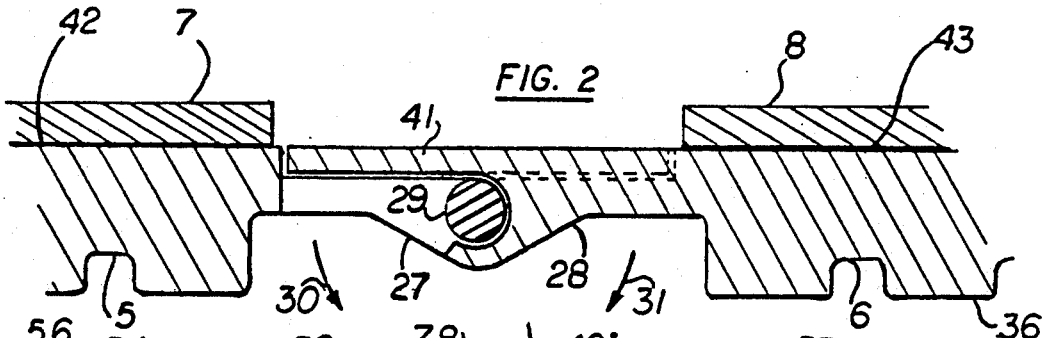
FIG. 2 is a cross-sectional view of the central hinge taken along line 2—2 of FIG. 1.

The hinged section 4 joining the two rigid frames 5, 6 is illustrated in FIG. 2. Each frame has a series of hinge extensions 27 that are interleaved with a similar series of extensions 28 projecting from the other frame around a pin 29. The platform can be folded for storage or transportation along the arrows 30, 31.

Figure 3:
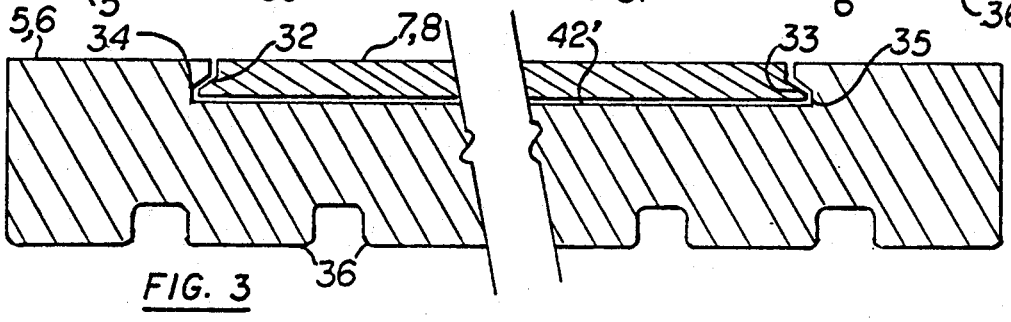
FIG. 3 is a cross-sectional view of each half of the platform taken along line 3—3 of FIG. 1.

FIG. 3 illustrates the position of one of the sheets 7, 8 on one of the frames 5, 6. The front and back edges of each sheet is shaped into tongues 32, 33 that are nested in grooves 34, 35 cut along corresponding edges of a depressed central area 42' of each frame. The sheets can easily be inserted into their respective frames when the platform is placed in its folded position. It should be noted that each frame could also be provided with a smooth and slippery surface avoiding the need for the sheet inserts.

Figure 4:
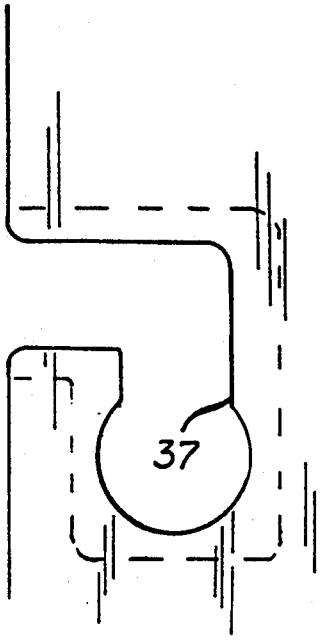
FIG. 4 is a top plan view of one of the anchoring notches.
Figure 5:
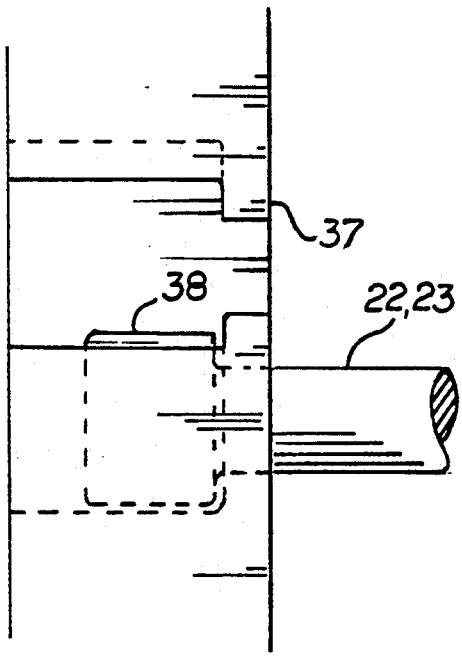
FIG. 5 is a side view thereof.
Figure 6:
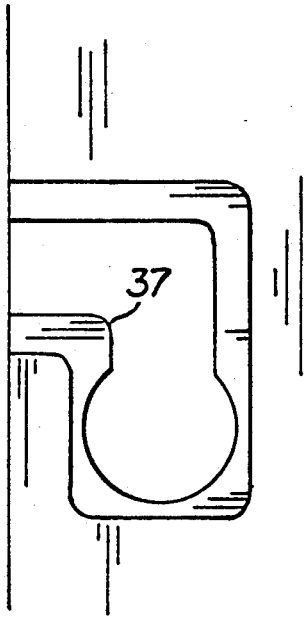
FIG. 6 is a bottom plan view thereof.

The undersurfaces of each frame is sculptured in a pattern of nibs 36 for better stability and adhesion to the floor. The geometry of each of the anchoring slots 11–20 is illustrated in FIGS. 4–6. Each slot has a flange 37 around its upper lip which retains the ball 38 placed at the end of a pulling element 22 or 23.

The platform may be conveniently carried when folded by means of handles 39, 40 projecting from the sides of the frames 5, 6.

The sliding surfaces 9, 10 may be made even more slippery by application of a lubricant. The platform may be used to perform a great variety of exercises by a user wearing wool, cotton or synthetic fabric socks and holding one or two pulling elements of various lengths.

Most exercises require sliding one foot at a time over the slippery surfaces 9, 10 while pulling or holding on to one or two pulling elements. The sliding can be done longitudinally or laterally in various standing, bending or crouching positions. It should be noted that the platform can be folded only in the direction indicated by the arrows 30, 31. The upper portion 41 of each interleaved hinge section 27, 28 extends over a part of an adjacent one thus preventing the folding of any frame 5, 6 upwardly. This arrangement allows the user to perform pulling exercises on elements 22, 23 separately or in combination with sliding ones. Indeed, by removing the sheets 7, 8 the user may stand directly over the upper surfaces 42, 43 of the frames that can be made rugged enough to prevent slipping. The number of musculature-developing exercises that can be practiced on the platform is almost limitless. For example, with pulling elements attached to the sides of the platform the following exercises can be performed:

alternate hand and leg side-to-side;
simultaneous arm and feet motion;
pull and twist;
squat and side pull;
dual feet side-to-side and pull;
sit down row;
side dip row; and
floor and slide exercise.

With the pulling elements attached to the front of the platform, the following exercises can be performed:

bicep routine alternating legs side-to-side;
bicep routine twisting feet;
bicep routine with not feet movement;
tricep routine alternating legs side-to-side;
tricep routine twisting fee;
tricep routine with no feet movement;
latissimus pull side-to-side;
latissimus pull with no feet movements;
no pulling element side-to-side exercise;
no pulling element twist;
no pulling element alternate side-to-side;
no pulling element front and back motion;
stretching no pulling element; and
stretching with pulling element.

Many other exercises can be devised to take full advantage of the practical features of the invention.

A second embodiment 44 of the sliding exerciser is illustrated in FIGS. 7–11. This alternate embodiment can also be used as a stool for performing stepping exercises.

Figure 7:
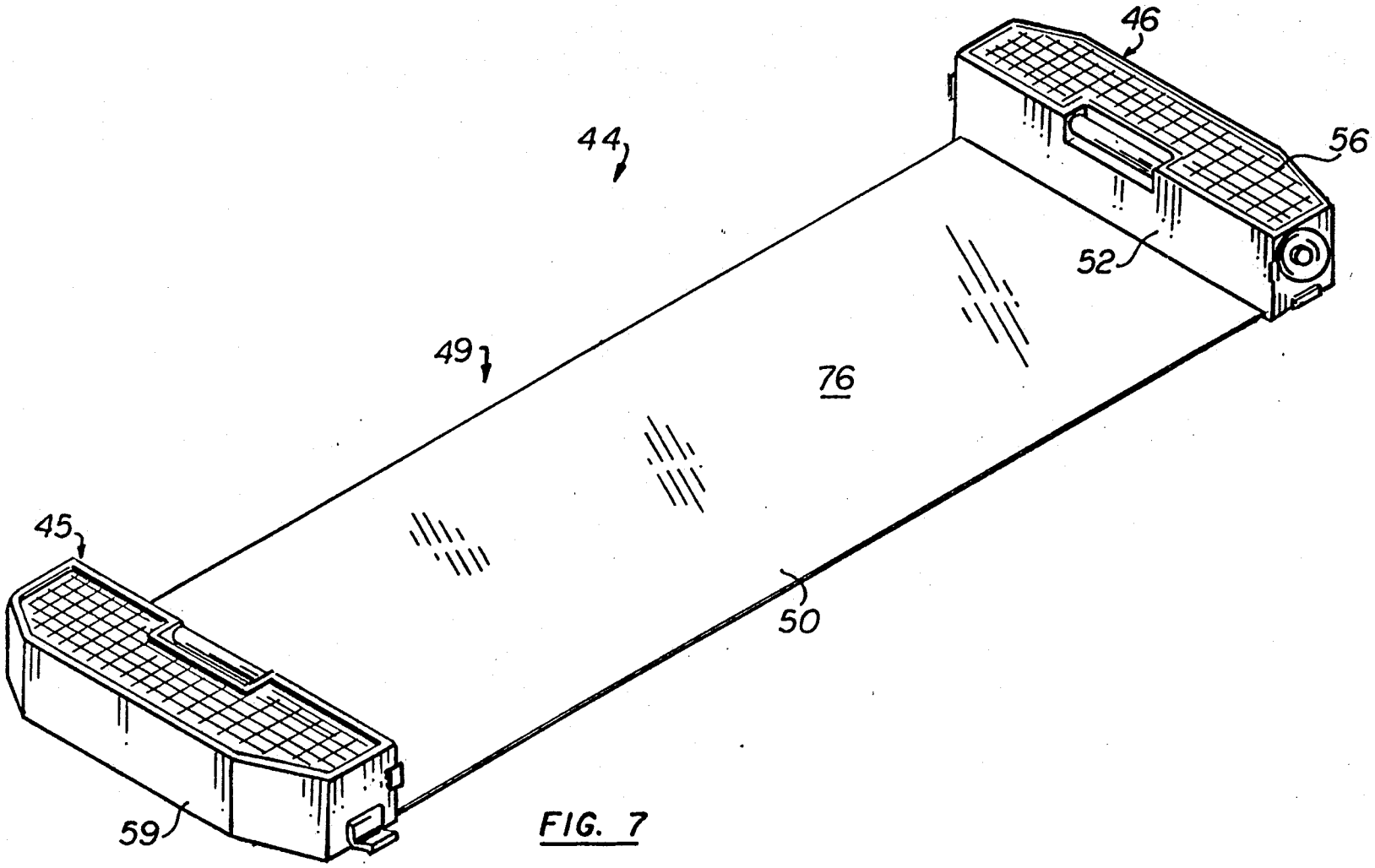
FIG. 7 is an isometric view of an alternate sliding exerciser in the deployed configuration.
Figure 8:
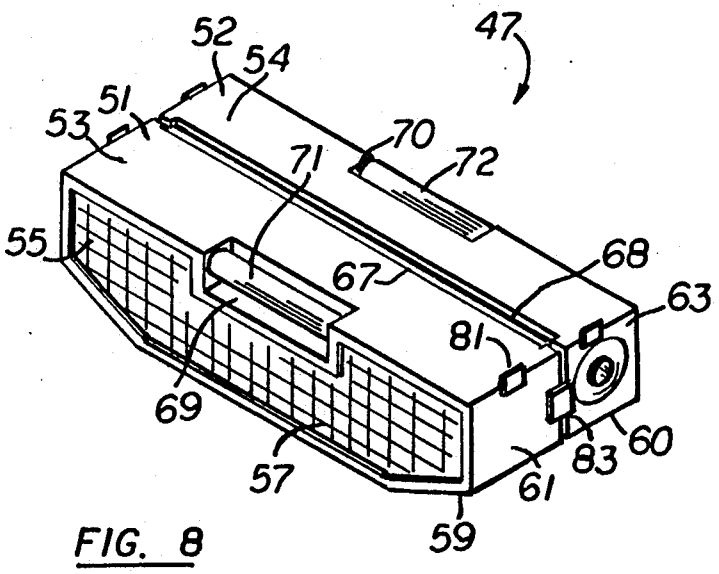
FIG. 8 is an isometric view thereof in a closed configuration.
Figure 9:
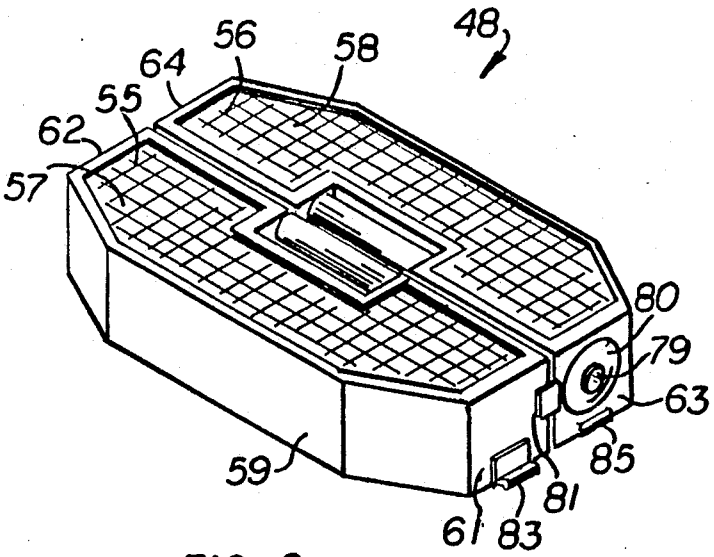
FIG. 9 is an perspective view thereof in a stepping exerciser configuration.

The combined stepping and sliding exerciser 44 comprises a substantially quadrangular housing split into two substantially symmetrical half-shells 45 and 46 that can either be brought together in a first configuration 47 to form a convenient carrying case or, in a second configuration, 48 to form a stepping platform as illustrated in FIG. 9, or placed on the floor in a spaced-apart arrangement 49 with a sliding web 50 spread between them to form a sliding exerciser illustrated in FIG. 7.

Figure 10:
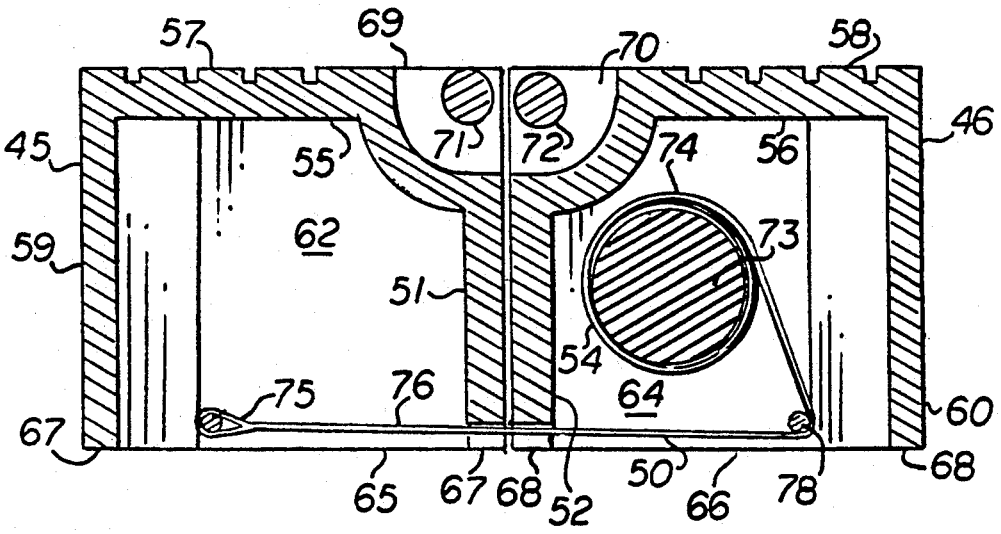
FIG. 10 is a cross-sectional view thereof.
Figure 11:
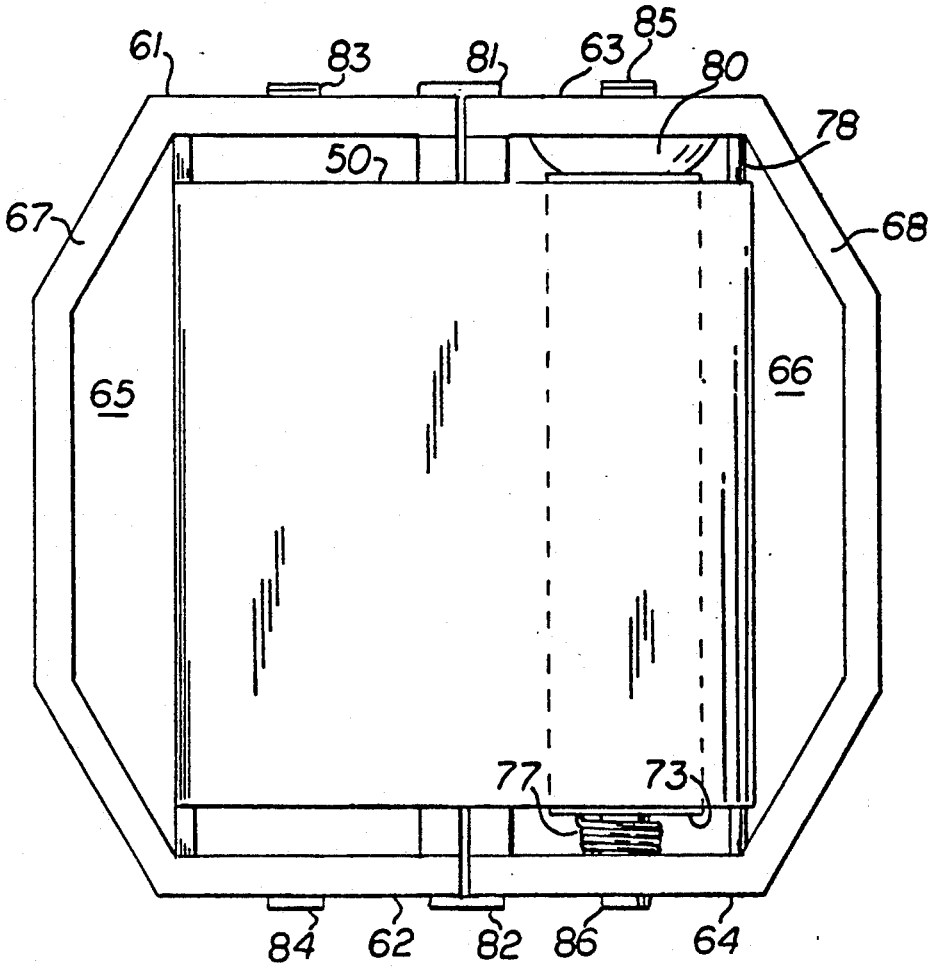
FIG. 11 is a bottom plan view thereof.
Figure 13:
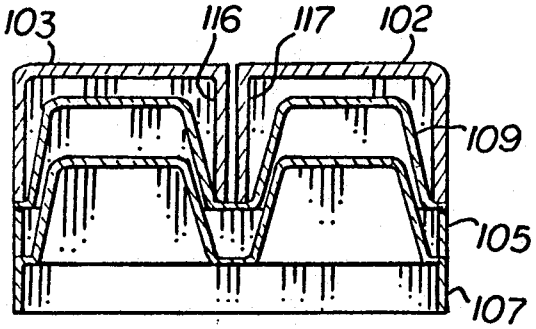
FIG. 13 is a cross-sectional view taken along line 13—13 of of FIG. 12.

Each half-shell comprises a top wall 51, 52 having a flat outer surface 53, 54, a back wall 55, 56 also having a flat outer surface 57, 58, the back wall being substantially orthogonal and contiguous with said top wall, a bottom wall 59, 60, and a pair of opposite end walls 61, 62 and 63, 64 which are orthogonally contiguous to the top, bottom and back walls. The open sides 65, 66 of the half-shells 45, 46 have mating, symmetrical peripheries or rims 67 and 68 that can be brought together along a median vertical plane to form the carrying case illustrated in FIG. 8. Quadrangular depressions 69, 70 are formed at the intersections of the top walls 51, 52 and the back walls 55, 56. Horizontal rods 71, 72 parallel to the interfacing plane of the two half-shells span the depressions 69 and 70 to form convenient carrying handles. As best illustrated in FIGS. 10 and 11, a drum 73 is rotatively mounted inside the right half-shell 46 between the end walls 63 and 64. The rotational axis of the drum is parallel to the back wall 57 and top wall 51. The web 50 has a first end section 74 wound around the drum 73. Its opposite end 75 is anchored inside the left half-shell 45. The web is coated with a slick material such as polypropylene or Teflon R forming a very slippery top surface 76. As explained in connection with the previously described embodiment, this top surface can be used to practice various sliding exercises. A coil-spring 77 having ends respectively anchored to the drum 73 and to one of the end walls 64 provides a resilient means for automatically rewinding the web around the drum. A roller 78 spanning the end walls 63 and 64 near the rim of the open side 66 of the right half-shell is used to position the web for an even deployment and rewinding around the drum. A nob 79 mounted in a depression 80 in one of the end walls 64 of the right half-shell is connected to the drum 73, and can be alternately used to rewind the web.

Starting from the configuration illustrated in FIGS. 9, 10 and 11 wherein the two flat outer surfaces of the top walls are held together in a face-to-face arrangement by means of locking mechanisms 81 and 82, the two half-shells can be spread apart to deploy the web as illustrated in FIG. 7. A second pair of mating locks 83, 84 and 85, 86 are used to secure the device in the carrying case configuration of FIG. 8. The flat outer surface of the back walls 55 and 56 are textured to form a anti-skidding top surface for the stepping stool configuration illustrated in FIG. 9.

Figure 12:
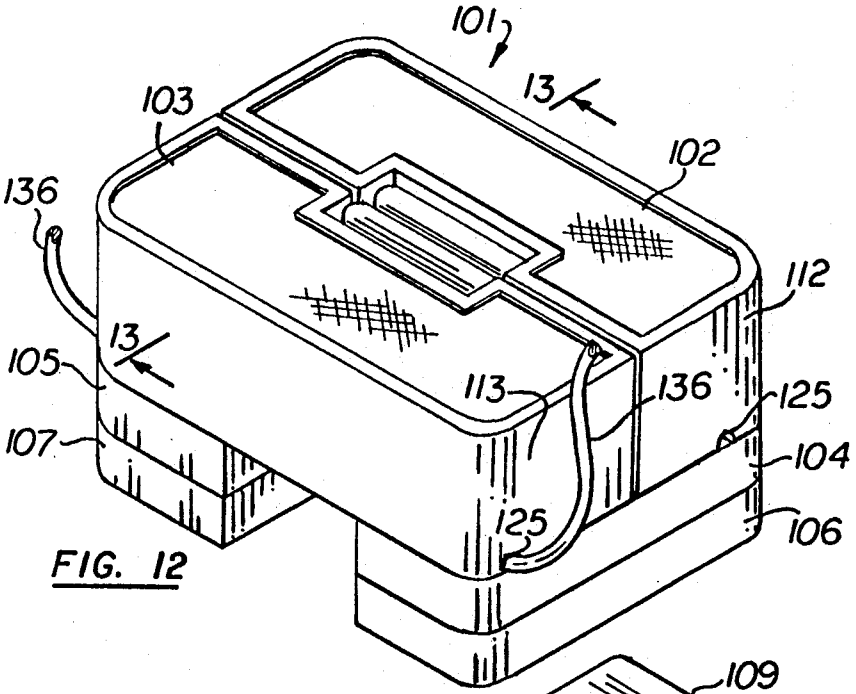
FIG. 12 is an isometric view of a third embodiment of the invention.
Figure 14:
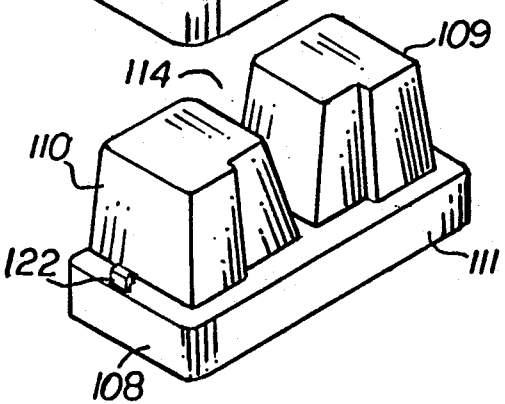
FIG. 14 is an isometric view of an extension.

In the third embodiment 101 of the invention illustrated in FIGS. 12–16, the two half-shells 102, 103 when in the stepping platform configuration can be elevated by pairs of stacked extensions 104, 105 and 106, 107 as shown in FIG. 12. It should be understood that alternately either, only one pair of extensions or more than two pairs may be used to raise the stepping platform to the desired height.

Figure 15:
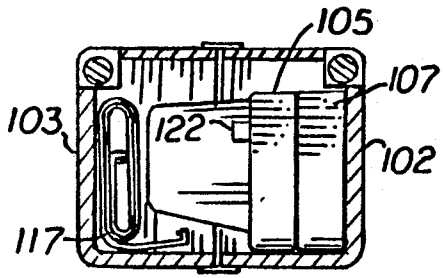
FIG. 15 is a cross-sectional view of the third embodiment in its storage configuration.

Each extension comprises a substantially quadrangular base 108 having two symmetrical and spaced-apart projections 109, 110 rising upwardly from the top surface of the base. One of the largest sides 111 of the base is commensurate in length with the total width of the contiguous end walls 112, 113 of the respective half-shells 102, 103. The gap 114 between the two projections is dimensioned to capture and hold together in a face-to-face arrangement, the top walls 115, 116 of the respective half-shells. The side of the projections 109, 110 are slightly tapering upwards to provide convenient nesting of the extension 107 into the hollow, open-bottomed extension 105 placed above it. The extensions are shaped and dimensioned to allow storage of at least one pair of nested extensions into the half-shells in the carrying case configuration as illustrated in FIG. 15.

It should be noted that in this third embodiment 101 of the invention the sliding web 117 is not wound on a roller, instead each end 118 is releasably anchored to the inside edge 119 of the top wall 115 or 116. In the preferred embodiment nibs 120 along the end 118 of the web are pushed into a series of holes 121 along the inside edge 119 of the half-shell in order to attach the end of the web to the half-shell 102 or 103.

Figure 17:
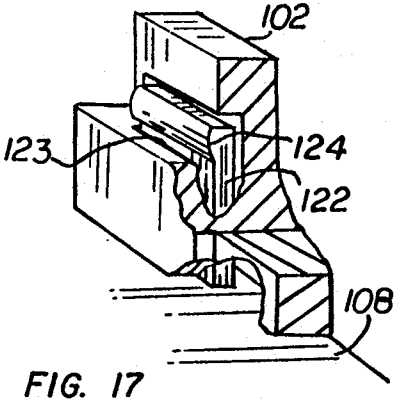
FIG. 17 is a detailed view of the extension latch mechanism.

The extensions are secured to the half-shells or to one another by means of the tongue-and-mortise latch mechanism illustrated in FIG. 17. The tongues 122 that project from the lateral edges of the base top surface engage mortises 123 formed in the bottom edges of each half-shell. Symmetrical mortises are also formed in the bottom edges of each extension base. Each tongue has a bead 124 along its upper end that provides for a positive locking of the extension against the half-shell or any other extension positioned immediately above it.

A series of notches 125 are provided around the rim of the open-side of each half-shell, through which can be engaged elastic ropes 136 similar in structure and purpose as the elastic cords 24 used in connection with the first embodiment of the invention.

Figure 19:
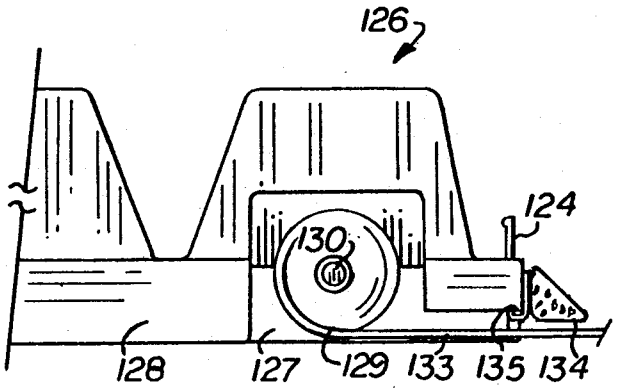
FIG. 19 is a median cross-sectional view showing the web roller supported by the extension.
Figure 16:
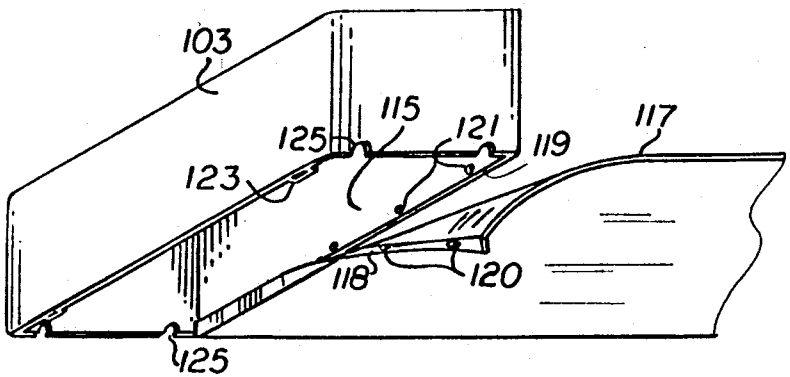
FIG. 16 is a detailed view of the web attachment.
Figure 18:
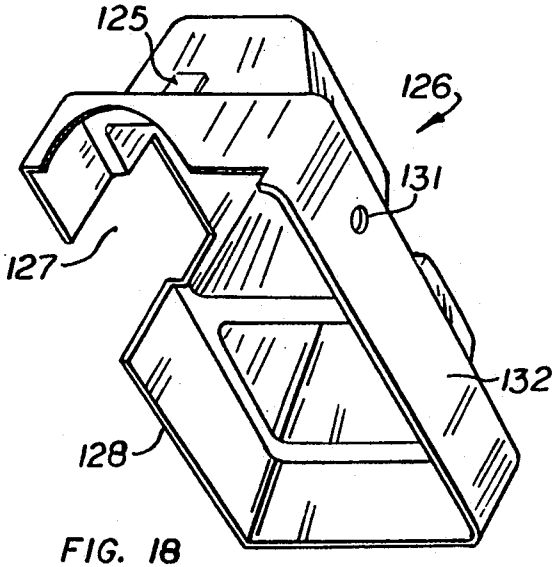
FIG. 18 is a bottom perspective view of an alternate embodiment of the extension.

An alternate embodiment 126 of the extension illustrated in FIGS. 18 and 19 has a cut-out 127 in the inner side wall 128 to accommodate a sliding web roller 129 whose shaft 130 is retained in the bearing hole 131 bored through the outer wall 132 of the base. The second extension placed opposite this alternate embodiment must be a mirror image thereof. The pair of extensions being used as the sole or lowermost set of extensions under the pair of half-shells holds the web-roller 129 in a convenient position for deployment of the web 133 as shown in FIG. 19. A foam bumper 134 is clipped to the trimmed lower edge 135 of the extension base through which the web is deployed. This bumper protects the user's foot during sliding exercise. A pair of such bumpers can also be secured to the edge of the top walls of the half-shells when the extensions are not used.

While the preferred embodiments of the invention have been described, modifications can be made and other embodiments may be devised without departing from the spirit of the invention and the scope of the appended claims.

What is claimed is:

1. An apparatus for practicing stepping and sliding exercises which comprises:

a substantially quadrangular housing comprising first and second substantially symmetrical half-shells having mating interfaces along a substantially vertical median plane; and a web having a first end securable to the first of said half-shells and an opposite end securable to the second of said half-shells being shaped and dimensioned so that they can be laid apart from each other joined by a length of the web, or alternately attached to each other along said interface, said web being stored within one of said half-shells;

wherein said web comprises a slick and slippery upper surface section;

wherein each of said half-shells comprises a top wall having a flat outer surface, a back wall having a flat outer surface substantially orthogonal to, and contiguous with, said top wall, a bottom wall, a pair of opposite end walls each being orthogonally contiguous to said top, bottom and back walls, and an open side; and wherein said apparatus further comprises means for holding the top walls in a contiguous face-to-face arrangement, whereby the outer surfaces of said back walls form a continuous platform when said half-shells are laid down side-by-side on their respective open sides.

2. The apparatus of claim 1, which further comprise means for supporting said half-shell in said contiguous face-to-face arrangement of the top walls above a ground surface.

3. The apparatus of claim 2, wherein said means for supporting comprise:

a pair of symmetrical extensions each of said extensions comprising a substantially rectangular base having a longest dimension commensurate with twice the length of one of said end walls between said top and bottom walls; and a pair of spaced-apart projections extending upwardly from said base, each of said projections being shaped and dimensioned to nest within one of said half-shells when said half-shells are mounted on said base wherein one of said projections on each extension extends into one of said half-shells and the other projection into the other half-shell.

4. The apparatus of claim 3, wherein said base and said extensions have upwardly tapering side walls whereby a plurality of said extensions can be nested into one-another.

5. The apparatus of claim 8, wherein each extension is shaped and dimensioned to nest entirely into one of said half-shells.

6. The apparatus of claim 5, which further comprise means for securing said extension under said half-shells.

7. The apparatus of claim 1, which further comprises means for releasably securing said first end of the web to one of the half-shells, and means for releasably securing the opposite end of the web to the other half-shell.

8. The apparatus of claim 1, which further comprises means for raising said half-shells above a ground surface.

9. The apparatus of claim 1, which further comprises:

a roller rotatively mounted within one of said half-shells along a horizontal axis parallel to said median plane; and said opposite end of said web being wound around said roller;

whereby said half-shells can be laid apart from each other joined by a length of the web, or alternately joined along said interface with a major portion of said web wound around said roller.

10. The apparatus of claim 1, wherein the outer surfaces of said back walls comprise a anti-skid texturing.

11. The apparatus of claim 10, which further comprises means for interlocking said half-she along an edge of each of their top, bottom and end walls to form a closed housing.

12. The apparatus of claim 11, which further comprises a carrying handle.

13. The apparatus of claim 12, wherein said handle comprises a jointing section of the top and back walls of one of said half-shells having a depressed area; and a bar spanning said depressed area.

14. The apparatus of claim 13, which further comprises means for rewinding the web around the drum.

15. The apparatus of claim 14, wherein said means for rewinding comprise a knob mounted against an outer surface of one of said end walls.

16. The apparatus of claim 14, wherein said means for rewinding comprise resilient means for opposing the unwinding of the web off said drum.

17. The apparatus of claim 8, wherein said means for raising comprise a pair of extensions, each of said extensions having a base and a projection extending vertically from said base, said projection being shaped and dimensioned to be insertd in said open side of a half-shell.

* * * * *